US009105216B2

(12) United States Patent
Inuzuka

(10) Patent No.: US 9,105,216 B2
(45) Date of Patent: Aug. 11, 2015

(54) COLOR SIGNAL GENERATING DEVICE

(75) Inventor: Tatsuki Inuzuka, Mito (JP)

(73) Assignees: JAPAN DISPLAY INC., Tokyo (JP); PANASONIC LIQUID CRYSTAL DISPLAY CO., LTD., Hyogo-Ken (JP)

( * ) Notice: Subject to any disclaimer, the term of this patent is extended or adjusted under 35 U.S.C. 154(b) by 996 days.

(21) Appl. No.: 12/343,518

(22) Filed: Dec. 24, 2008

(65) Prior Publication Data

US 2009/0167779 A1 Jul. 2, 2009

(30) Foreign Application Priority Data

Dec. 27, 2007 (JP) ..... 2007-335509

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 2320/0233* (2013.01); *G09G 2320/0242* (2013.01); *G09G 2340/0428* (2013.01); *G09G 2340/0457* (2013.01); *G09G 2340/06* (2013.01)

(58) Field of Classification Search
CPC ..... H04N 7/26808; H04N 7/364; H04N 19/0063; H04N 19/00739
USPC ..... 345/596–599, 613, 616, 690, 694
See application file for complete search history.

(56) References Cited

U.S. PATENT DOCUMENTS 4,910,694 A * 3/1990 Walther ..... 348/246
5,337,160 A * 8/1994 Jones ..... 358/447
5,561,751 A * 10/1996 Wong ..... 345/589
5,822,467 A * 10/1998 Lopez et al. ..... 382/261
6,208,763 B1 * 3/2001 Avinash ..... 382/254
6,288,728 B1 * 9/2001 Satoh et al. ..... 345/519
6,714,206 B1 * 3/2004 Martin et al. ..... 345/589
6,774,943 B1 * 8/2004 Kao et al. ..... 348/252
7,006,109 B2 * 2/2006 Toji et al. ..... 345/613
7,130,477 B1 * 10/2006 Schillings ..... 382/254
7,148,901 B2 * 12/2006 Belmon et al. ..... 345/589
7,522,172 B2 * 4/2009 Tanase et al. ..... 345/603

(Continued)

FOREIGN PATENT DOCUMENTS

JP 2004-538523 12/2004

*Primary Examiner* — David Zarka
*Assistant Examiner* — Phong Nguyen
(74) *Attorney, Agent, or Firm* — Lowe Hauptman & Ham, LLP

(57) ABSTRACT

An object of the present invention is to provide a color signal generating device where the size of the operational circuit is small and the speed of signal processing is fast. The color signal generating device for converting signals from a first color signal for forming a number of input pixels to a second color signal for forming a number of output pixels is provided with: a signal gradient detecting means for detecting a gradient of color signals in a reference pixel within the number of input pixels; a signal distributing means for comparing the first color signal for the reference pixel where the gradient is detected and the second color signal for the reference pixel of the number of output pixels corresponding to the reference pixel and stored in advance in the case where the gradient is detected, and distributing a color signal to a periphery pixel adjacent to the reference pixel having the second color signal in the case where the first color signal has a color which the second color signal does not; and a signal modifying means for converting the first color signal for forming a number of input pixels to a second color signal on the basis of the distributed color signal.

11 Claims, 14 Drawing Sheets

(56) References Cited

U.S. PATENT DOCUMENTS

| | | | | |
|---|---|---|---|---|
| 8,063,913 | B2 * | 11/2011 | Choe et al. | 345/611 |
| 2003/0034992 | A1 * | 2/2003 | Brown Elliott et al. | 345/690 |
| 2003/0063210 | A1 * | 4/2003 | Tsuboi | 348/340 |
| 2004/0066467 | A1 * | 4/2004 | Hahn | 348/458 |
| 2004/0114046 | A1 * | 6/2004 | Lee et al. | 348/279 |
| 2005/0099426 | A1 * | 5/2005 | Primerano et al. | 345/589 |
| 2005/0231534 | A1 * | 10/2005 | Lee | 345/690 |
| 2006/0125842 | A1 * | 6/2006 | Kim et al. | 345/611 |
| 2006/0215191 | A1 * | 9/2006 | Tanase et al. | 358/1.9 |
| 2006/0268003 | A1 * | 11/2006 | Tanase et al. | 345/603 |
| 2006/0274212 | A1 * | 12/2006 | Lo et al. | 348/650 |
| 2007/0047838 | A1 * | 3/2007 | Milanfar et al. | 382/289 |
| 2007/0273626 | A1 * | 11/2007 | Kerofsky et al. | 345/87 |
| 2007/0296871 | A1 * | 12/2007 | Yoo et al. | 348/701 |
| 2008/0030660 | A1 * | 2/2008 | Roth et al. | 349/106 |
| 2008/0049042 | A1 * | 2/2008 | Yang et al. | 345/589 |
| 2008/0056604 | A1 * | 3/2008 | Choe et al. | 382/269 |
| 2008/0123152 | A1 * | 5/2008 | Goto et al. | 358/3.27 |
| 2009/0224245 | A1 * | 9/2009 | Umezaki | 257/59 |
| 2010/0013748 | A1 * | 1/2010 | Cok et al. | 345/83 |
| 2010/0013848 | A1 * | 1/2010 | Hekstra et al. | 345/589 |
| 2010/0225567 | A1 * | 9/2010 | Koebrich et al. | 345/55 |

* cited by examiner

COLOR SIGNAL GENERATING DEVICE

The present application claims priority over Japanese Application JP 2007-335509 filed on Dec. 27, 2007, the contents of which are hereby incorporated into this application by reference.

BACKGROUND OF THE INVENTION (1) Field of the Invention

The present invention relates to a color signal generating device for a display device for displaying color images.

(2) Related Art Statement

A great number of display devices for reproducing images have been proposed and used. The properties of such display devices are evaluated on the basis of their characteristics, such as the resolution, the brightness, the contrast, and the color reproducibility, and compared. In some cases, different weight is given to these values for determination, depending on the environment in which the display device is used.

In the case where a display device, for example a portable terminal, is carried around and used in various environments, the surrounding brightness (luminous intensity) changes greatly. It is desired for the brightness of the screen to be high, in order to maintain the visibility of the screen even in bright places. As a method for forming a display device for increasing the brightness, there is a method for adding W pixels. In general, the pixels of a display device are formed as a combination of three colors: R, G and B (red, green and blue).

In the comparison using the wavelength distribution, R, G and B have only a partial wavelength range, while W has a broader wavelength range covering R, G and B. In other words, W is an achromatic color having no significant wavelength distribution. Therefore, W is appropriate for achieving higher brightness than R, G and B. Thus, the above described object of increasing the brightness can be achieved by adding W as pixels for the display device.

Many signal systems for expressing images using analog or digital signals have been proposed in order to reproduce images using a display device. There are RGB, CMY, YUV and XYZ, for example as signal expressions for color based on the human sense of sight. It is known that the resolution in terms of the brightness is higher than the resolution in terms of colors to the human sense of sight. Television broadcasting signals are an example of a signal format based on this fact, and a technology using the brightness Y and a color difference signal C as color signals and setting the frequency properties of the former higher than the latter is used.

Incidentally, the configuration of pixels for inputted color signals is not created on the basis of the pixels in the display device as in the above described example of television signals. Accordingly, signal conversion in the configuration of the pixels becomes indispensable in the generation of drive signals for a display device using RGBW as described above when general color signals are inputted.

Patent Document 1 relates to such signal conversion.

(Patent Document 1) Japanese Translation of International Unexamined Patent Publication 2004-538523

SUMMARY OF THE INVENTION

Problem to be Solved by the Invention

In accordance with conventional color conversion methods, however, all of the pixels within a screen are scanned in sequence as reference pixels, and therefore, a memory (or register) for storing signal values for reference pixels within the range for integral calculus, a multiplication and addition operating circuit for multiplying each of the reference pixels by a weight coefficient and adding them up, a control circuit for carrying out the above described signal process on all of the pixels inside the screen in sequence and the like are required, and thus, problems arise, such that the size of the operational circuit increases and the signal process becomes more complex, and the power consumption increases together with this.

An object of the present invention is to provide a color signal generating device where the operational circuit is smaller and the speed of signal processing is faster.

Means for Solving Problem

In order to solve the above described problem, the present invention provides a color signal generating device for converting signals from a first color signal for forming a number of input pixels to a second color signal for forming a number of output pixels having: a signal gradient detecting means for detecting a gradient of color signals in a reference pixel within the number of input pixels; a signal distributing means for comparing the first color signal for the reference pixel where the gradient is detected and the second color signal for the reference pixel of the number of output pixels corresponding to the reference pixel and stored in advance in the case where the gradient is detected, and distributing a color signal to a periphery pixel adjacent to the reference pixel having the second color signal in the case where the first color signal has a color which the second color signal does not; and a signal modifying means for converting the first color signal for forming a number of input pixels to a second color signal on the basis of the distributed color signal.

Effects of the Invention

A color signal generating device where the size of the operational circuit is small and the speed of signal processing is high can be provided.

EXPLANATION OF SYMBOLS

Figure 1:
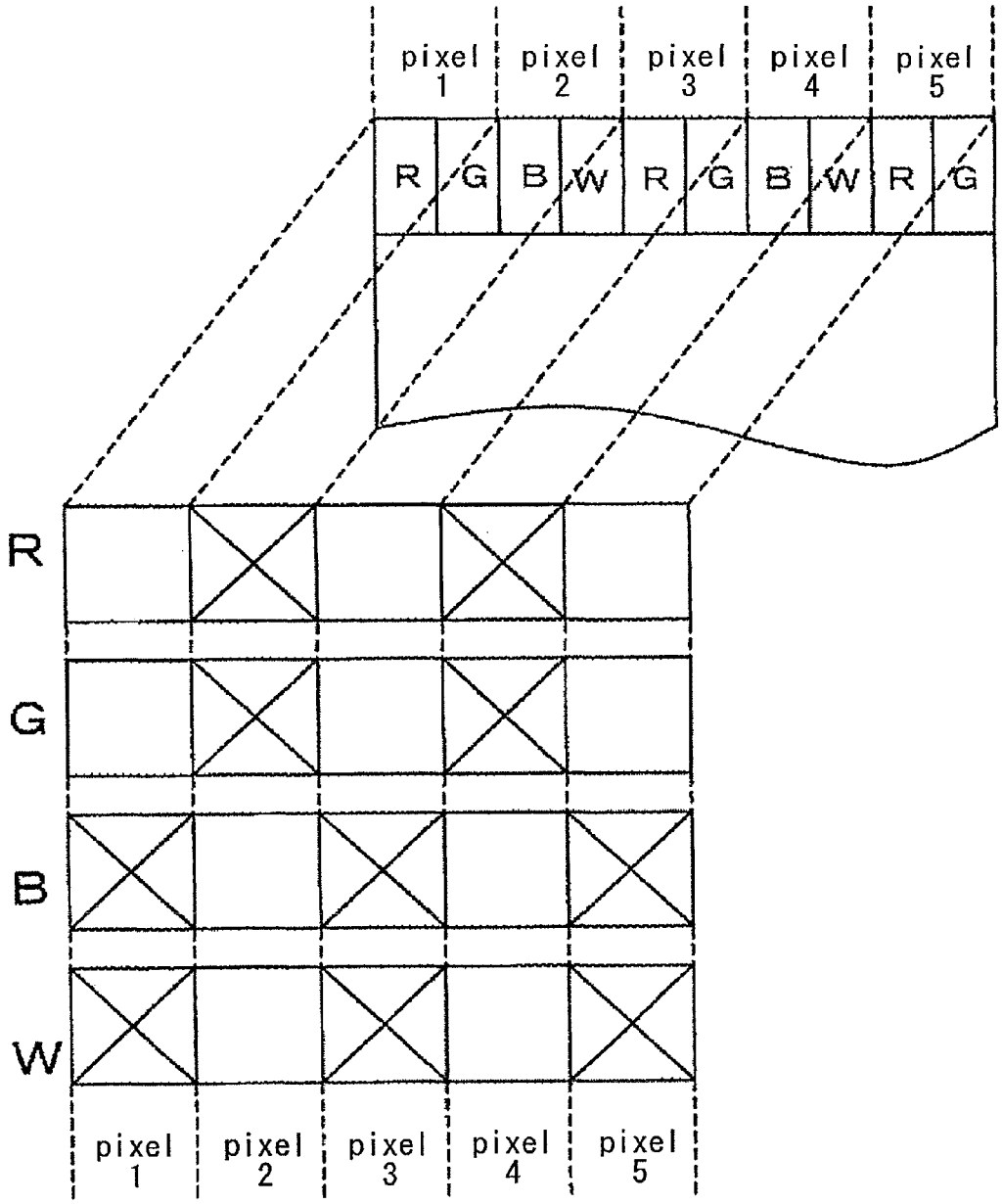
FIG. 1 is a diagram showing the correspondence between the location of pixels on a display device and the type of colors that can be displayed.
Figure 1:
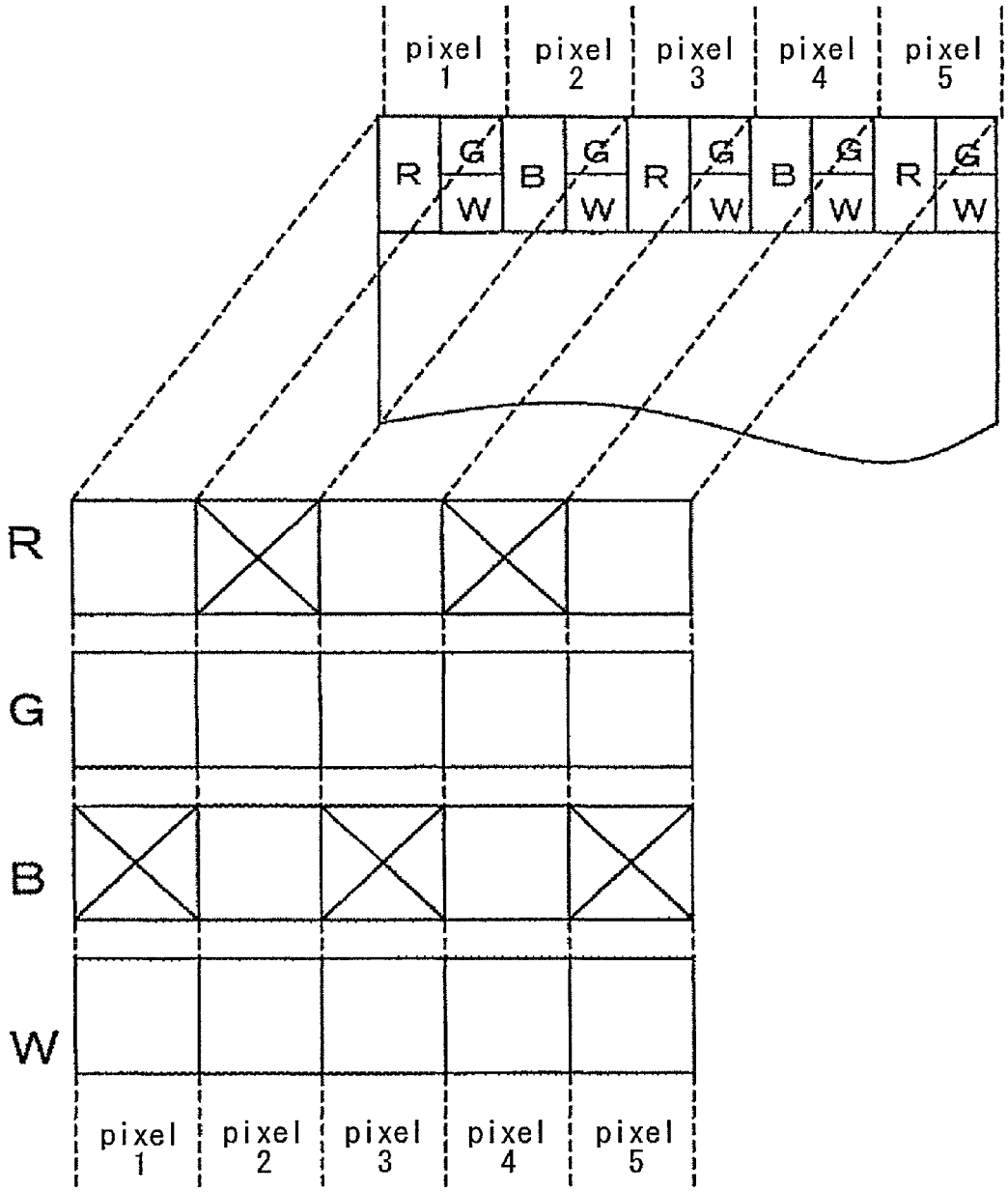

107 panel pixel configuration setting signal
108 panel pixel configuration storing means
109 panel pixel configuration signal
101, 221, 500 input signal
102, 222 output signal
103 memory
104 signal modifying means
105 signal gradient detecting means
106 signal distributing means
110 read-out signal
201 registers Xi, Xj, Xk
204 adding means
205 registers Xi*, Xj*, Xk*
223 sub-pixel rendering means (R, G, B, W)
224 color substituting signal line (R, G, B)
225 pixel aligning means
310 pixel location converting means
311 color type converting means
312 conversion ratio setting means
313 signal combining means
314 converting ratio signal
501 image memory
502 W generating means
503 sub-pixel rendering means
504 panel drive signal calculating means
505 BL drive signal calculating means
506 liquid crystal panel
507 backlight

DETAILED DESCRIPTION OF THE INVENTION

Best Mode for Carrying Out the Invention

The present invention provides a color signal generating device for converting signals from a first color signal for forming a number of input pixels to a second color signal for forming a number of output pixels having: a signal gradient detecting means for detecting a gradient of color signals in a reference pixel within the number of input pixels; a signal distributing means for comparing the first color signal for the reference pixel where the gradient is detected and the second color signal for the reference pixel of the number of output pixels corresponding to the reference pixel and stored in advance in the case where the gradient is detected, and distributing a color signal to a periphery pixel adjacent to the reference pixel having the second color signal in the case where the first color signal has a color which the second color signal does not; and a signal modifying means for converting the first color signal for forming a number of input pixels to a second color signal on the basis of the distributed color signal.

The basic operation according to the present invention is signal distribution on the basis of the direction and size of the signal gradient, and is based on the idea of differentiation. Thus, the present invention is characterized in that the number of pixels accessed during the operation is small, the load of the operation is small, and the speed of signal processing is fast. In addition, the circuit configuration does not require high precision in operation, and therefore, the circuit configuration can be made simple and the size of the operational circuit can be reduced.

Concretely, according to the present invention, an input signal is converted to a drive signal for the display device in the case where the pixel configuration of an input signal is a combination of single pixels of three primary colors: R, G and B, the pixel configuration of the display device provides a subset of three types of single pixels: R, G and B, and a combination of a number of pixels can provide a combination of three primary colors: R, G and B.

Furthermore, the pixel configuration of an input signal is a combination of single pixels for four primary colors: R, G, B and W, and the pixel configuration of the display device is a subset of single pixels of four primary colors: R, G, B and W, and thus, input signals are converted to drive signals for the display device in the case where a combination of a number of pixels provides a combination of four primary colors: R, G, B and W.

In the following description, in input signals, all of the pixels are created as combinations of signals for all colors.

A combination of color signals for the display device corresponding to this pixel location is also referred to as pixel. Here, the pixels in the display device may be combinations of color signals which are different from the input signals. In a pixel, the minimum unit for displaying a color is referred to as a pixel. In the present invention, the number of pixels for forming a screen is the same between the input signal and the display device. This is a condition for facilitating implementation, and in the case where the number of pixels in an input signal is different from in the display device, a signal process for so-called expansion and contraction may be carried out in advance, so that the number of pixels in the input signal coincides with that in the display device.

In the following, a case where pixels for forming a screen are aligned in lines is described, but the description applies to cases where pixels are arranged in two dimensions.

FIG. 1(1) shows a case where there are four types of input signals: R, G, B and W, and the display device shows two types of pixels: RG and BW, when they are alternately aligned. The figure shows a state where the correspondence between the location of pixels in the display device and the type of colors that can be displayed is different for each pixel. The pixel 1 can display RG but not BW (× in the figure), and the pixel 2 cannot display RG (× in the figure) but can display BW. The remaining pixels are the same, and thus, two adjacent pixels can be combined, and four colors: R, G, B and W, can be displayed.

FIG. 1(2) shows a case where there are four types of input signals: R, G, B and W, and two types of pixels: RGW and GBW are alternately aligned in the display device. The pixel 1 can display RGW but not B (× in the figure), and the pixel 2 cannot display R (× in the figure) but can display GBW. The remaining pixels are the same, and two adjacent pixels can be combined, and thus, four colors: R, G, B and W, can be displayed.

Figure 2:
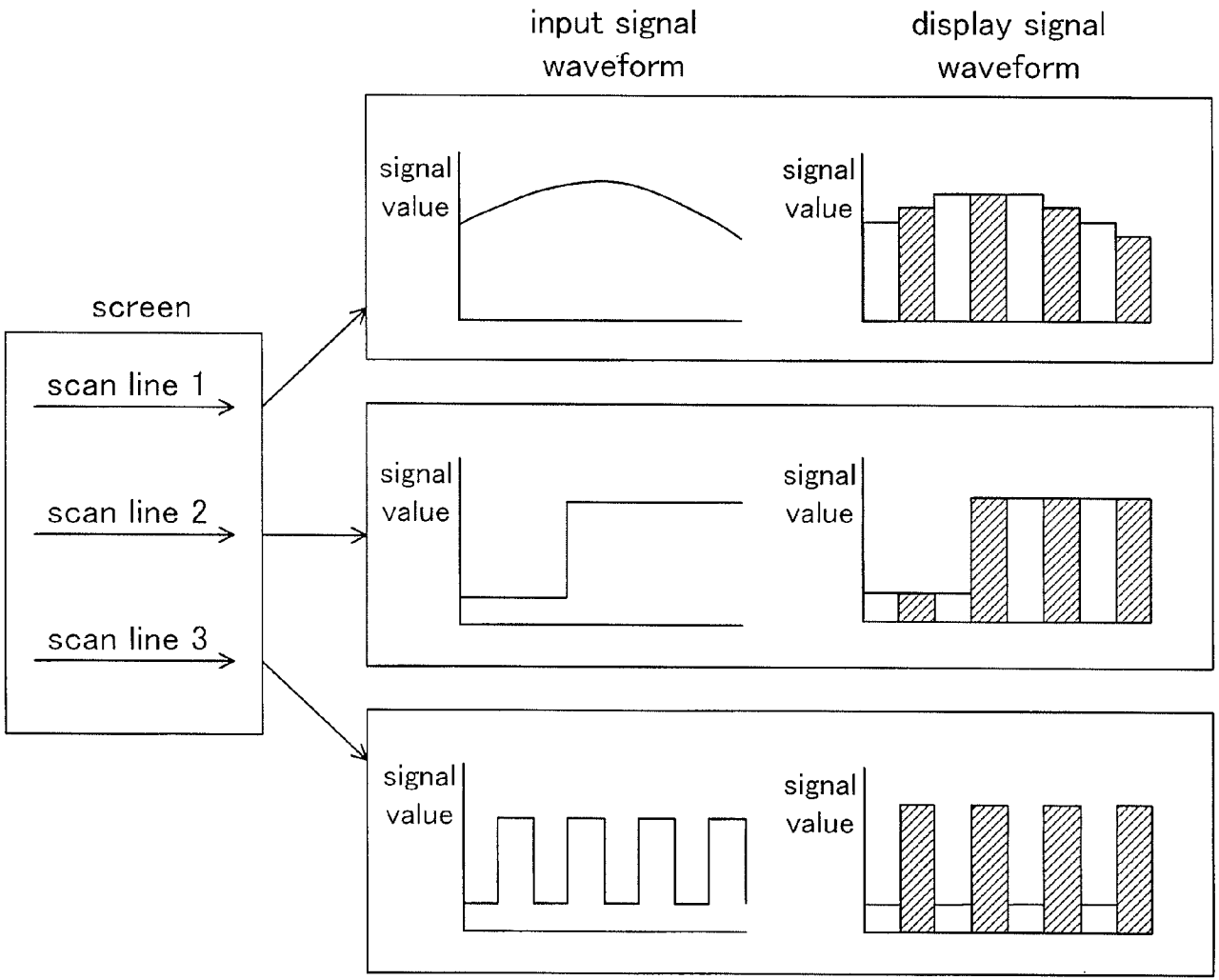
FIG. 2 is a diagram showing input signals and change in the signals per line in the display output.

FIG. 2 shows the change in the signal per line of the input signal and the display output in the present invention. The input signal for each pixel is a combination of signals for three colors: R, G and B. Each pixel in the display device is formed of a subset of three colors: R, G and B, or four colors: R, G, B and W, and two types of pixels: red/green (RG) and blue/white (BW), or red/green/white (RGW) and blue/green/white (BGW) form pixels, for example.

These pixels of a number of types are mixed and aligned on a screen. The following three types of input signal waveforms per line are shown:

(1) Signals which change smoothly (2) Signals with steps (3) Signals with vibration Signals in pixels in locations which cannot be displayed due to the pixel configuration of the display device are hatched as the pixel signal waveforms on the right in the figure. That is to say, only white portions of the display signal waveforms are displayed.

A smooth input signal waveform can output the outline of a waveform only with pixels that can be displayed. An input signal waveform with a step can maintain the outline of the waveform in the same manner as the above described smooth signal waveform in regions excluding the step. However, it can be seen that in the step region, there is great error in the location of pixels with a step. The input signal waveform with a vibration is the same as repeated regions with a step, each of which is the same as the above described waveform with a step, and thus, there is great error. Thus, in the case where the input signal and the pixel configuration of the display device are different, there is sometimes great error in the display output. This corresponds to cases where information included in the input signal is discarded. In other words, some of the energy of the input signal is discarded. Furthermore, in the case where information included in the input signal is discarded due to the display device in an information terminal, information conveyance sometimes fails to play its role.

The present invention is characterized in that signals are converted on the basis of the pixel configuration on the panel in the case where the input signal and the pixel configuration of the display device are different (in the case where the pixel configuration is different between the input signal and the output signal).

Figure 3:
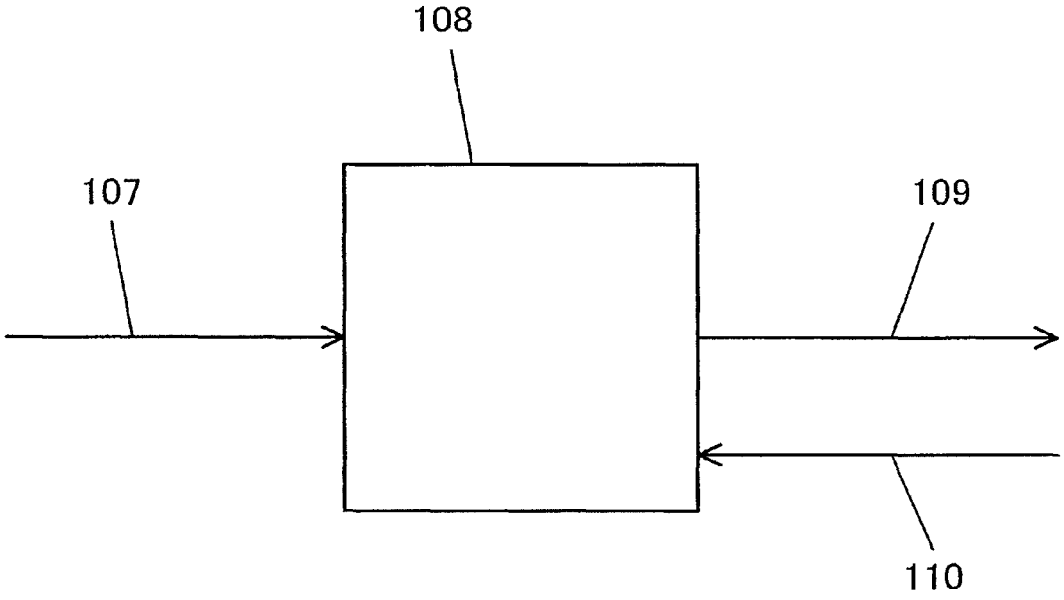
FIG. 3 is a diagram showing an example of the configuration of a panel pixel formation storing means according to the present invention.
Figure 3:
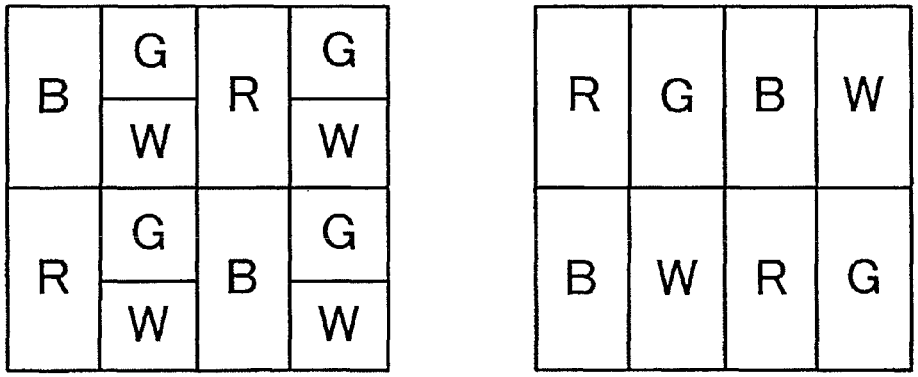

FIG. 3(1) shows the configuration of a panel pixel configuration storing means 108 according to the present invention. This panel pixel configuration storing means 108 is provided with a memory means, such as a memory or a register, and has a means into which a panel pixel configuration setting signal 107 for the pixel configuration is outputted from the outside, and a means for outputting the stored panel pixel configuration signal 109. Any panel pixel configuration can be inputted, and there is the configuration shown in FIG. 3(2), for example. Thus, data on the pixel configuration is written into a register at the time of initiation of circuits. Meanwhile, data on the set configuration of pixels is read out through various methods. In general, many image processes are carried out in the order of scan lines of pixels within the image. In the case where there is a means for managing the order, the above described data may be read out on the basis of the signal for the location of the pixels set by this means.

Therefore, the panel pixel configuration storing means 108 can be provided with a means into which a signal for the location of pixels is inputted as a read-out signal 110. Thus, data on the configuration of pixels read out at the time of actual operation for signal conversion can be referred to on the basis of the location of pixels in signal processing in later stages.

In the following description relating to the configuration of the device, the connection with the panel pixel configuration signal 109 is sometimes not clearly shown; this is because the signal is perceived as a basic signal, for example power supply lines, clocks and the like.

Figure 4:
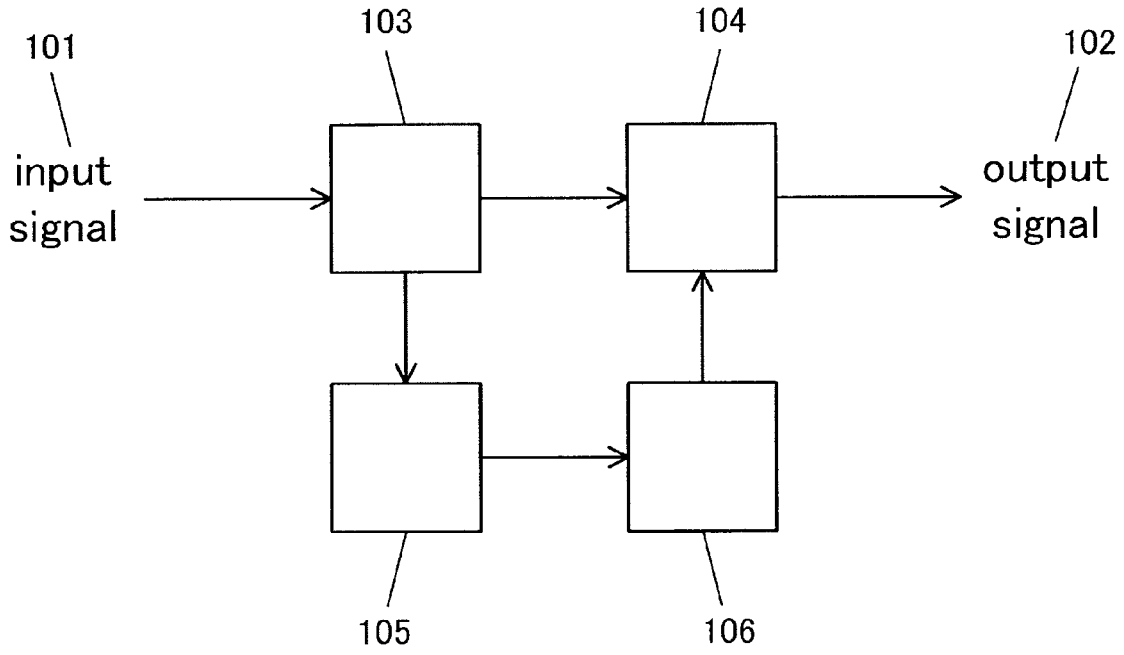
FIG. 4 is a diagram showing one embodiment of the color signal generating device according to the present invention.

FIG. 4 shows an example of the configuration of a color signal generating device according to the present invention.

As described above, signal conversion is unnecessary for color signals which can be displayed in the correspondence between the input signal and the pixel configuration of the display device. However, in the correspondence between the input signal and the pixel configuration of the display device, signal conversion for color signals which cannot be displayed is required. That is to say, signal conversion from the first color signal for a number of pixels forming the input signal to the second color signal for a number of pixels of an output signal outputted to the display device becomes necessary.

The present invention provides the above described means for signal conversion.

The input signal 101 is a combination of four color signals: R, G, B and W.

In the following procedure, color is limited to R, G, B and W for the purpose of simplifying the description. In addition, the connection with the panel pixel configuration storing means 108 is not clearly described, but there is an appropriate connection. Adjacent pixels IJK along one line having signal values (color signals) for a certain color are Xi, Xj and Xk. The above described color cannot be displayed in the pixel location J in the display device, but can be displayed in the pixel locations I and K. In the present invention, signal conversion is carried out so as to substitute the color signal Xj with adjacent pixels I and K. That is to say, signal conversion is necessary in the case where a certain pixel cannot be displayed; that is to say, a first color signal cannot be displayed as it is using a second color signal which is the pixel configuration of the display device.

The memory 103, which is a memory means, temporarily stores the above described input signal 101 in order to process the signal in later stages. The memory 103 is at least a three-line memory. The signal gradient detecting means 105 refers to a number of pixel signals stored in the memory 103, and thus, the signal gradient within the reference pixel is detected. Here, the signal gradient is a value showing the direction and size of signal change which can be calculated from the relationship between the location of the pixel on the screen and the signal value, and the size of the signal gradient of the reference pixel J is: $\Delta Xi=(Xi-Xk)$.

These signal processes can be carried out through operation in sync with the display timing of the pixel units of the display device. Therefore, a means for receiving signals for the operation timing from the display device side can be provided, though this is not shown. Alternatively, a timing signal for displaying pixel units may be outputted to the display device.

It is easy to increase the number of referred pixels, expand the signal in two dimensions, and use vector expressions as the data format.

The signal distributing means 106 sets a distribution coefficient D ($0 \le D \le 1$) for distributing the color signal Xj for the pixel J to pixels I and K on the basis of the signal gradient calculated in the above in the case where the signal gradient is detected. The signal modifying means 104 modifies the color signals Xi and Xk of the pixels I and K on the basis of the above described distribution coefficient. When the distribution coefficient is Di and Dk, for example, modification is carried out as:

$$Xi^*=Xi+Xj\cdot Di$$

$$Xk^*=Xk+Xj\cdot Dk$$

(Xi* and Xk* in the formulas indicate numeral values after modification) In accordance with the method for setting a distribution coefficient, the ratio of distribution can be increased in the direction in which the gradient becomes higher (in the direction toward pixels where the original signal values are high). The distribution coefficient can be set using an appropriate table or calculated using an appropriate function, or a means for setting the distribution coefficient using an external means can be prepared.

In an example where the distribution ratio is set directly through calculation from the signal values Xi and Xk using a function, $$Di=(Xi-\mathrm{MIN}(Xi,Xk))/(\mathrm{MAX}(Xi,Xk)-\mathrm{MIN}(Xi,Xk))$$

$$Dk=(Xk-\mathrm{MIN}(Xi,Xk))/(\mathrm{MAX}(Xi,Xk)-\mathrm{MIN}(Xi,Xk))$$

Here, the function MAX ( ) is whichever the maximum value is within the parentheses, and the function MIN ( ) is whichever the minimum value is within the parentheses. The denominators in the above formulas normalize the distribution coefficient D. In addition, the standard for determining whether or not there is signal distribution T1 (>0), T2 (<0), and the setting values D1 and D2, are provided so as that the following procedure can be used:

```
IF (Δ Xj > T1)
    Di = D1, Dk = 0
ELSE IF (Δ Xj < T2)
    Dk = 0, Dk = D2
ELSE
    Di = 0, Dk = 0
```

Though the signal value Xj of the reference pixel is not used in the above example, a setting method using the signal value may be used. The above described method for setting Di and Dk may be expressed in a more general manner using a certain function F:

$$Di=Fi(Di,Dj,Dk)$$

$$Dk=Fk(Di,Dj,Dk)$$

Here, in the case where the signal waveform is uniform and Xi=Xk, Di=0 and Dk=0, and $$Xi^*=Xi, Xk^*=Xk$$

In the case where the signal waveform is smoother than this, almost no signal is modified, and the operation maintains the original signal values. Meanwhile, in the case where there is change in the signal waveform, the operation emphasizes this change. This operation of emphasizing change corresponds to a signal process referred to as edge emphasis. In addition, the signal process for edge emphasis corresponds to a signal process generally referred to as differential operation. In the case where the signal waveform is smooth, no modification of signals means that there are no effects of precision with the operation. That is to say, the original signal values are maintained irrespectively of the operational circuit where the above described procedure is carried out, and the manner in which the operation program is created.

Meanwhile, many signal processes corresponding to edge emphasis are used in the field of image processing; this is because the outline is significant as the properties of the sense of sight and barely any precision is required with the operation for the signal values.

Here, other characteristics of the present invention are described on the basis of the above describe properties.

In some cases, gamma properties corresponding to the input properties of the imaging device and the display device are provided in general image signals, and signal conversion for the gamma properties (gamma conversion, gamma inversion) become necessary in order to gain linearity in the signals. However, this signal conversion is nonlinear, and therefore, operation is difficult. A conversion table can be used, but the size of the table becomes great in order to increase the precision. In contrast, according to the present invention, high linearity in the subject signal is not required when the signal process corresponds to edge emphasis, and thus, signal conversion for gamma properties can be made unnecessary, and effects of achieving reduction in the size of the circuits can be gained.

Figure 5:
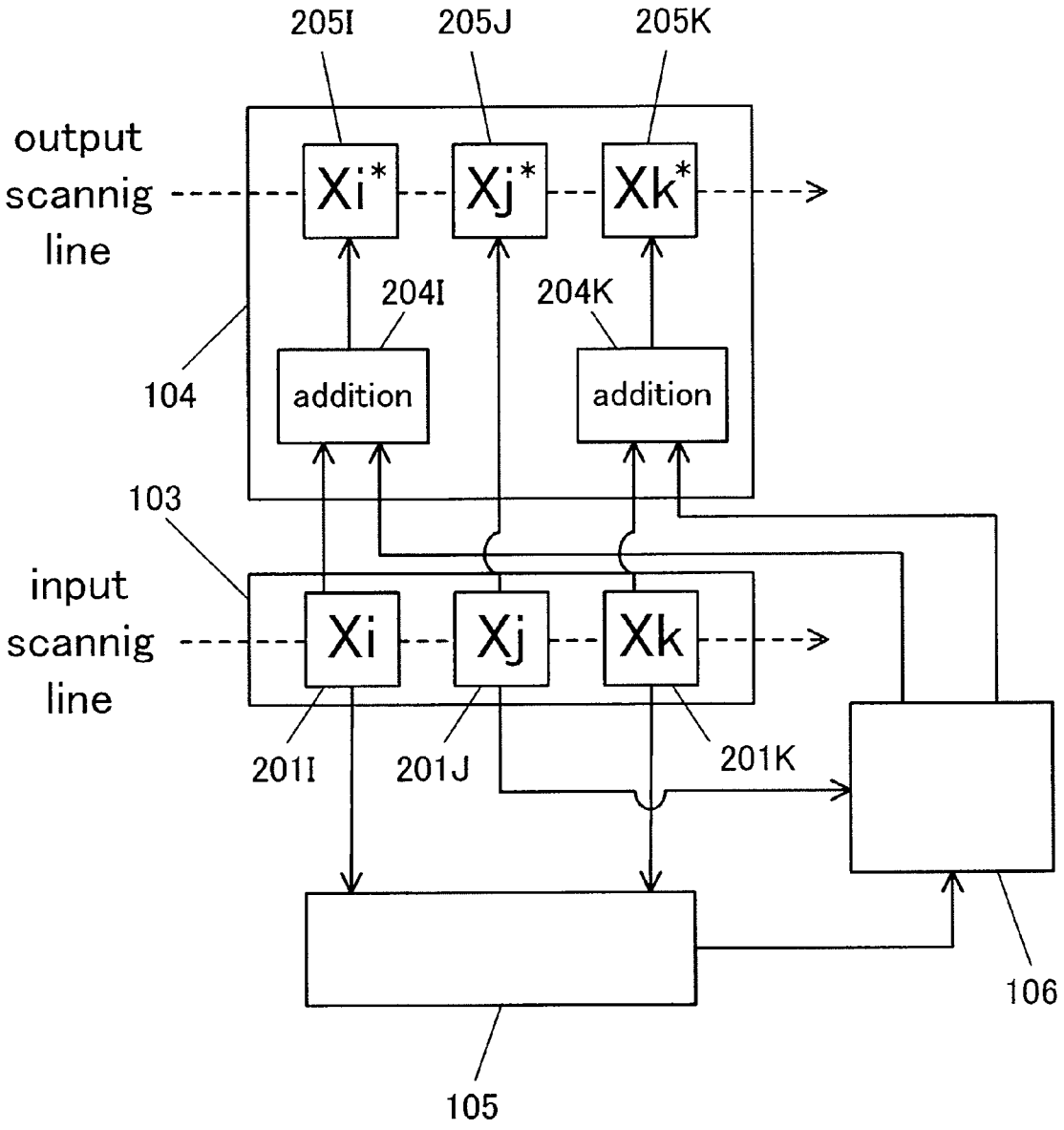
FIG. 5 is a diagram showing the color signal generating device according to the present invention in detail.

FIG. 5 shows the above described basic configuration of the present invention in another format. The input signals are any of R, G, B and W, of which the difference is not shown. In addition, though the connection with the panel pixel configuration storing means 108 is not clearly shown, there is an appropriate connection.

The signal value for three adjacent pixels I, J and K along one line is Xi, Xj and Xk, and the register for storing these is 201 (I, J, K).

Signals Xi and Xk for the pixels I and K which are adjacent to the above described reference pixel J are inputted into the signal gradient detecting means 105, and the signal distributing means 106 for calculating the gradient ΔXj=(Xi−Xk) sets the distribution ratio for distributing the signal Xj of the reference pixel J to pixels I and K on the basis of the above described gradient ΔXj, and distributes the signal Xj of the reference pixel J in the above described ratio. The distributed signals are respectively added to the signals Xi and Xk using the adding means, and thus, modified values Xi* and Xk* are gained. These modified values are stored in the register 205 for temporarily storing signals. The figures show the reference pixel Xj as stored in the register in order to show the correspondence between the input and the output, but the signal for the pixel cannot be displayed as described above, and thus, this may be omitted.

Figure 6:
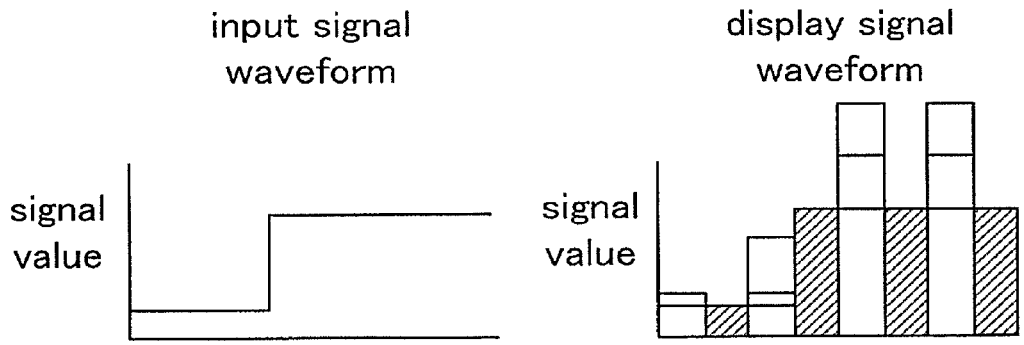
FIG. 6 is a diagram showing the results of signal modification according to the present invention.
Figure 6:
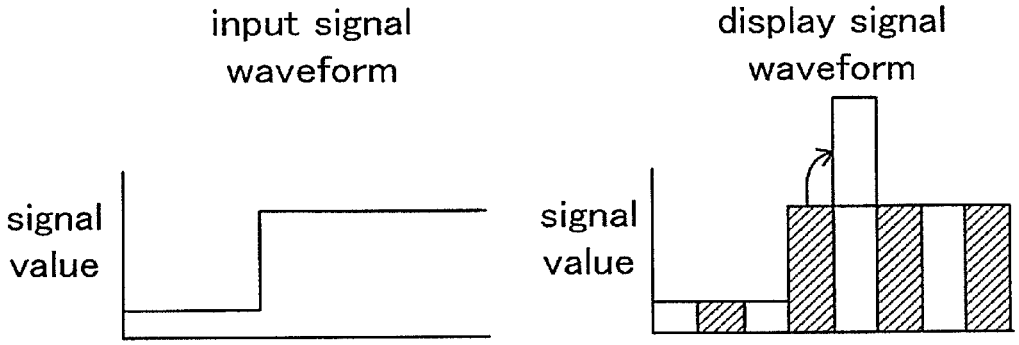

FIG. 6 shows the results of signal modification. As described above, there are few effects when the waveform is modified in the signal region where there is a smooth signal change. Meanwhile, effects of waveform modification are required in the signal region where there is great signal change. According to the present invention, the direction and size of signal change is detected, and a color signal in the position of a pixel which cannot be displayed in distributed to a color signal in the position of a pixel which can be displayed. (1) in the figure is the results of modification in the case where the distribution ratio Di and Dk are set uniformly.

$$Xi^*=Xi+Xj\cdot(1/2)$$

$$Xk^*=Xk+Xj\cdot(1/2)$$

That is to say, color signals (hatched portions) of pixels which cannot be displayed are uniformly distributed to color signals (white portions) of adjacent pixels which can be displayed. As a result, such properties that change in the signal in the step portion becomes gradual are provided. (2) in the figure is the results of modification in the case where the distribution ratio is set as a variable on the basis of the signal gradient. Concretely, the signal value of the reference pixel is distributed in the direction in which the signal gradient becomes higher, and in other portions, the distribution is set to 0. In this example, such properties that change in the signal in the step portion is emphasized are provided.

The above described setting of the distribution ratio may affect the image quality in accordance with the human sense of sight, and therefore, an optimal setting method cannot necessarily be set. This includes cases where the setting depends on the properties of the display device. Therefore, a means for variable setting in which any setting is possible can be prepared.

In addition, a number of means for determining the distribution ratio may be prepared, so that one can be selected from among these.

In the above, a procedure for a signal process which does not depend on the color is shown. That is to say, in the case where the input signal is R, G, B or W, the basic procedure for a signal process is the same, though there may be a difference in the pixel configuration, depending on the color.

Figure 7:
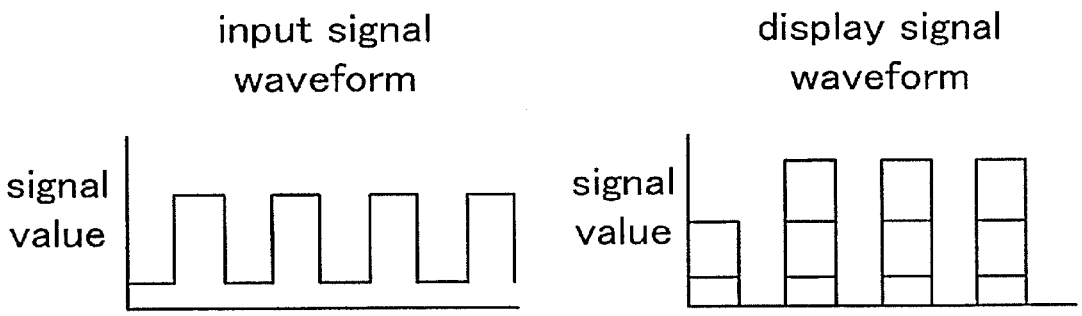
FIG. 7 is a diagram showing the results of signal modification according to the present invention.
Figure 7:
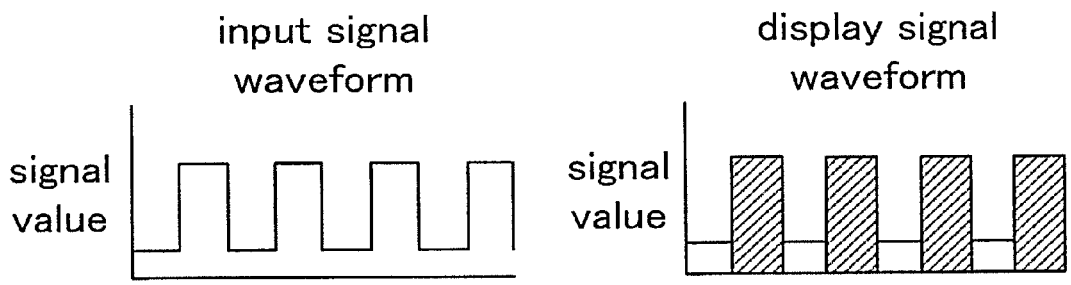

A procedure for a signal process where signals are exchanged between different colors is shown as another example of the configuration of the present invention. FIG. 7(1) shows an example where signals of the location of pixels which cannot be displayed are uniformly distributed to signals in the location of adjacent pixels which can be displayed.

According to this method, the energy of the input signal is conserved, but there is a shift in the location of signal amplitude by a unit of sub-pixels when compared to the input signal waveform.

This can be referred to as phase shift of the signal.

As another distribution method, a distribution coefficient can be set on the basis of the signal gradient of pixels which can be displayed adjacent to the reference pixel, but the energy of the input signal is greatly damaged when this method is used. As described above, image data created with fine outlines, such as letters and figures, may become a factor in the image quality deteriorating, for example lowering of the resolution.

For the conditions for the deterioration of image quality due to phase shift as described above, a case can be cited where the amplitude of signals of adjacent pixels which can be displayed increases through signal distribution of signals which cannot be expressed to adjacent pixels when the signal of the reference pixel which cannot be displayed is relatively high and signals of adjacent pixels which can be displayed are relatively uniform. This can be expressed in the following conditional formula when the reference pixel is J, adjacent referred pixels are I and K, signal values for these are Xj, Xi and Xk, and new standards for determination are T0, T1 and T2:

$$\text{IF } ((Xj>T0) \text{ AND } (\Delta Xj<T1) \text{ AND } (\Delta Xj<T2))$$

or when other new standards for determination are T0, T1 and T2, $$\text{IF } ((Xj>T0) \text{ AND } (Xj<T1) \text{ AND } (Xk<T2))$$

As described above, whether or not the image quality deteriorates due to phase shift can be determined through the determination as to whether or not the above described conditions are met, for example. The present invention is characterized by being provided with a means for determining whether or not the above described conditions are met. In addition, the below described signal process for preventing deterioration is carried out.

The present invention is characterized in that signals are distributed between signals having different colors in order to maintain the phase of the amplitude of signals as shown in FIG. 7(2). In the figure, the hatched regions indicate displays with a color different from the white regions. In the case where the pixel configuration on the display panel is as shown in FIG. 1(2), for example, W sub-pixels are provided with all of the pixels. W is achromatic color, and the human sense of sight is sensitive to this. Therefore, color signals which cannot be displayed are substituted with signals for W sub-pixels in the same location for pixels. As a result, the display signal waveform for the brightness can maintain the same phase as the input signal waveform.

The color signals with which signals are substituted can be other color signals in the same pixel. However, when the signals are substituted with W, which is achromatic color, change in color can be prevented even when substituted. Alternatively, slight change in the color may be allowed for the purpose of substitution in the component of brightness, and thus, in the present invention, color signals which cannot be displayed can be substituted with signals for G sub-pixels in the same location for pixels. Alternatively, color signals which cannot be displayed may be substituted with a combination of color signals for a number of colors in the same location for pixels. The following description relates to an example where the signals are substituted with W sub-pixels.

Figure 8:
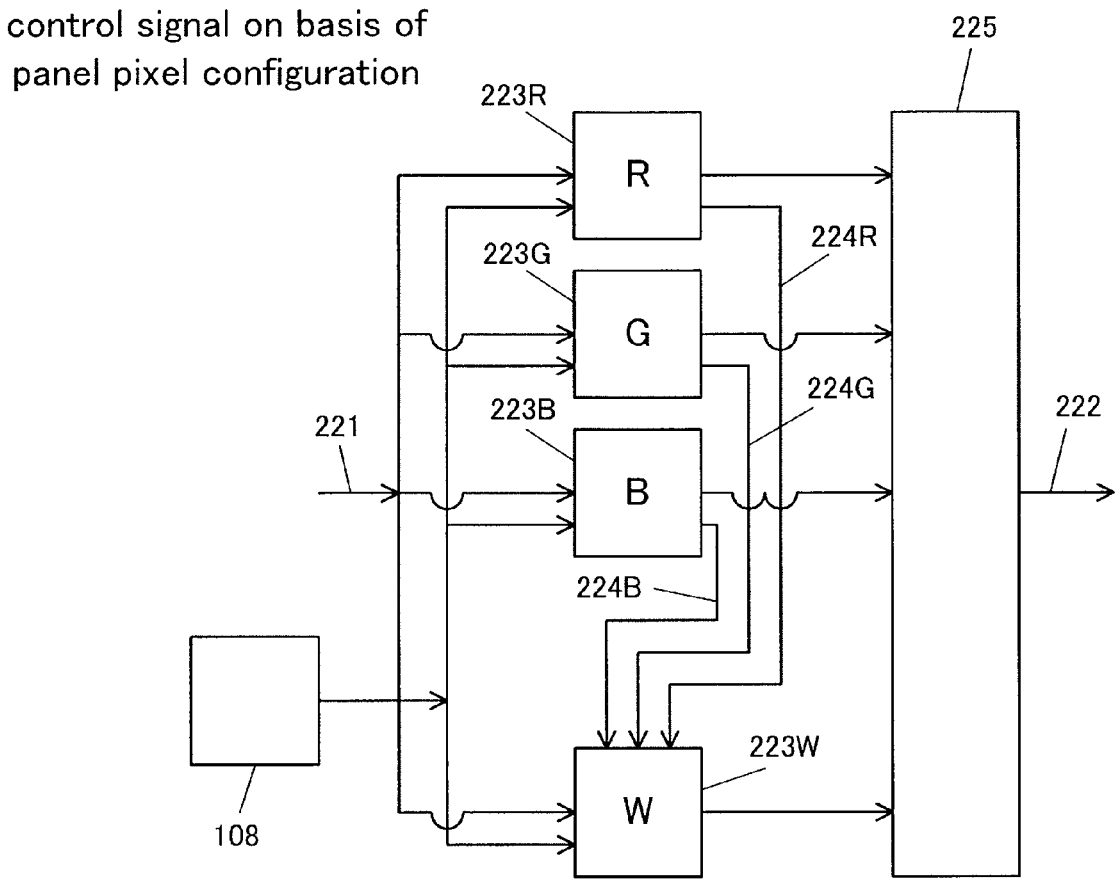
FIG. 8 is a diagram showing the configuration of the entire device, including the color signal generating device according to the present invention.

FIG. 8 shows the configuration of the device where signals are distributed between colors according to the present invention. 223 is a device for signal conversion on the basis of the difference in the pixel configuration between the input signal and the display device, and referred to as sub-pixel rendering means. The input signal 221 is a combination of R, G, B and W signals in each pixel, and the respective color signals are conveyed to the respective corresponding sub-pixel rendering means. The operation inside the individual sub-pixel rendering means is the same as above. In addition, signals are outputted as output signals 222 after signal conversion, after conversion to a signal series required for display in sync with the operation timing of the display device using the pixel aligning means 225.

Here, color substitution signal lines 224 (224R, 224G and 224B) are prepared in the sub-pixel rendering means 223R, 223G and 223B, and the signal distribution for the color signal which cannot be displayed is substitution with a W signal in the case where the conditions for deterioration of image quality due to phase shift resulting from the modification of signals through signal distribution are determined to have been met.

In addition, signals generated by these sub-pixel rendering means 223 are collectively outputted as an output signal 222 in an appropriate format using the pixel aligning means 225. The signal distribution naturally depends on the pixel configuration on the display panel, and accordingly, a means for referring to the data on the picture configuration on the display panel is prepared, though this is not shown. In order to do so, the figure shows the connection with the panel pixel configuration storing means 108. In order to achieve concrete operation, finer connections are required, but they are omitted here.

Figure 9:
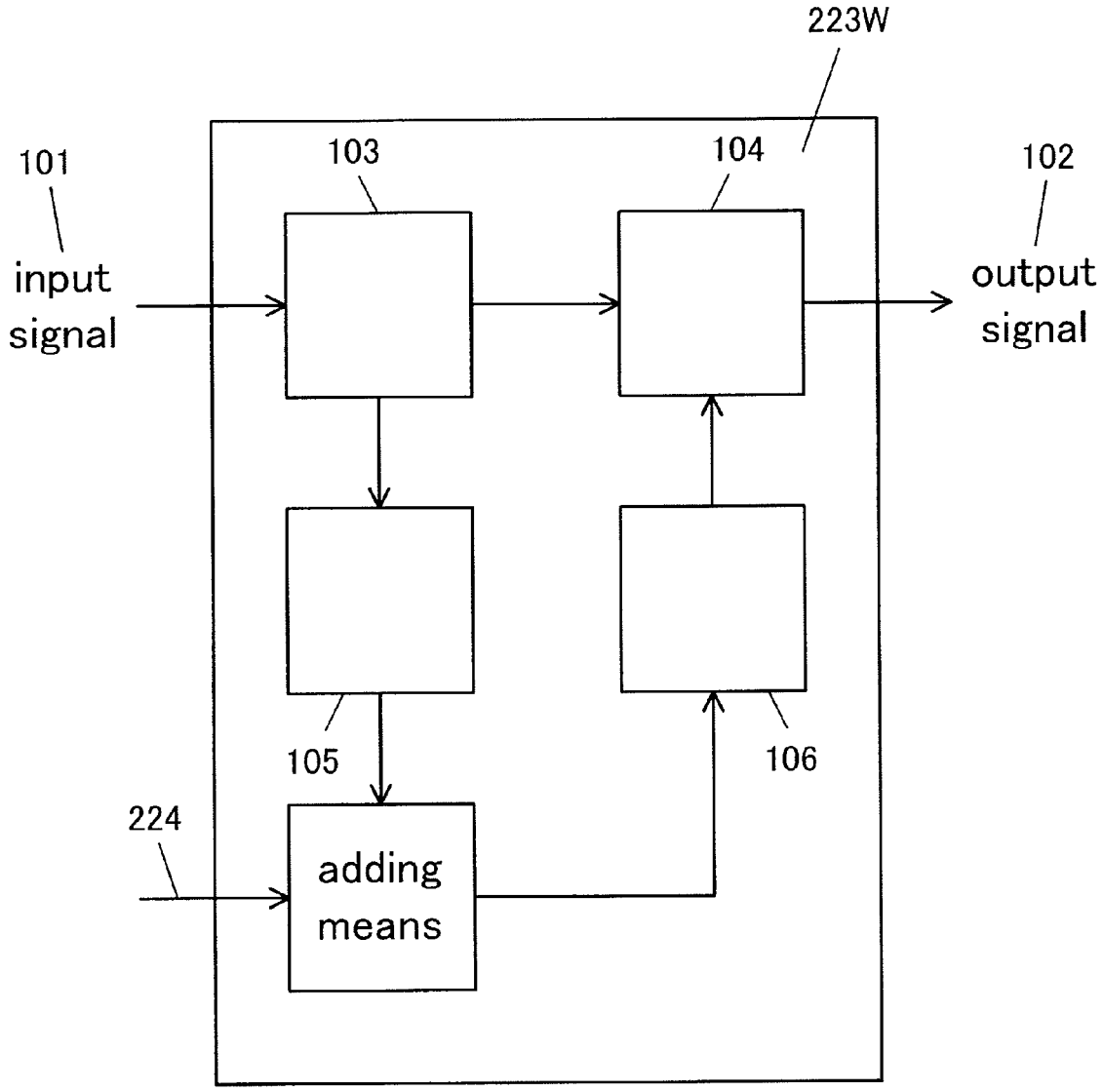
FIG. 9 is a diagram showing an example of the internal configuration of the sub-pixel rendering means according to the present invention.

FIG. 9 shows the internal configuration of the sub-pixel rendering means 223W for a W signal.

The input signals 101 and 221 have the same operation. An input means for the above described color substitution signal lines 224 (224R, 224G and 224B) is prepared and dealt with in the same manner as the signal outputted by its own signal gradient detecting means 105, and thus, the signal value gained by adding up these in the adding means 226 is passed on to the signal distributing means 106. Then, the signal modifying means 104 modifies and displays the W signal.

As described above, fine lines of letters and figures for which the location of pixels for display is significant can be displayed by substituting these with a W component while maintaining the location for the pixels, even when there are no sub-pixels which can be displayed in the location for the pixels. In many cases, discerning of brightness (W component) is easier than discerning of colors for the display with units of sub-pixels for fine lines as described above, due to the effects of resolution on the sense of sight. The present invention has effects of displaying with high resolution using the sense of sight.

Figure 10:
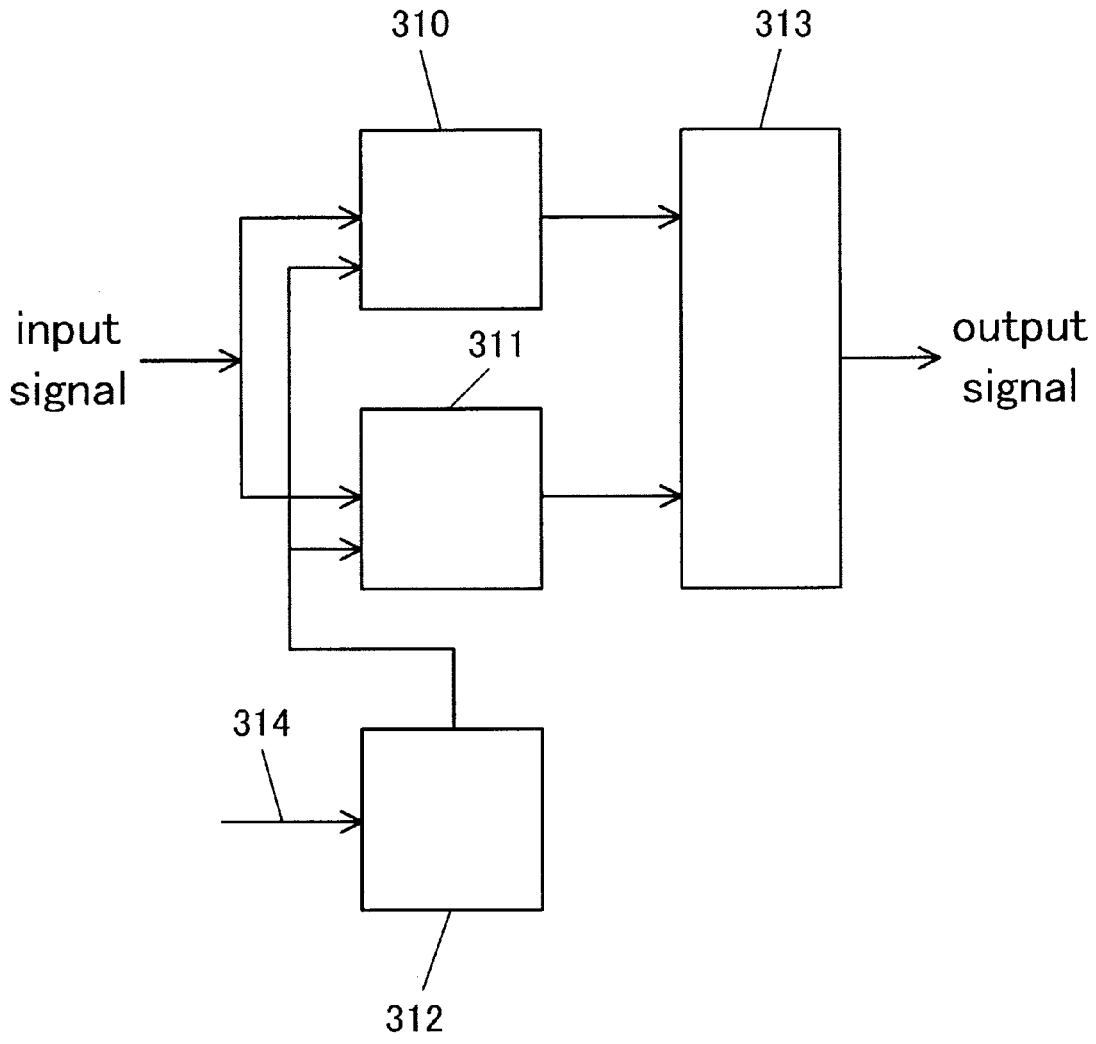
FIG. 10 is a diagram showing the operation of the conversion ratio setting means according to the present invention.

As described above, the present invention is provided with two types of signal conversion: conversion of the location of pixels, and conversion of colors. FIG. 10 shows a configuration where these two methods for signal conversion are organized from different points of view. The pixel location converting means 310 is a means for converting a color signal which cannot be displayed due to the location of a pixel in the display device to a signal for location of a pixel which is different from the location of the pixel. The color converting means 311 is a means for converting a color signal which cannot be displayed due to the location of a pixel in the display device to a color signal for a different color in the location of a pixel. The respective concrete device configurations are combinations of the above described circuit configurations. Though the two in the figure are independent means 310 and 311, they may have a single circuit configuration where operation changes depending on the set parameters.

According to the present invention, one of the two types of signal conversion can be selected for use. Alternatively, a conversion ratio setting means 312 is prepared so that the above described two types of operation can be controlled, and thus, the conversion method can provide a combination of operations with an appropriate ratio. In the case where the two are independent circuits, a signal combining means 313 can be used so as to output one output signal.

Here, the conversion ratio signal 314 increases the ratio of the color converting means 311 in the case where the input signal relates to fine a pattern, for example fine lines, because discerning of the component of brightness is easier than for color, or increases the ratio of the pixel location converting means 310 in the case where the reproducibility of color is important. In the case where the display screen is fabricated on the basis of HTML, for example, the fineness of the letters and figures formed on the screen may be found by interpreting the HTML code. The above described conversion ratio can be determined on the basis of what is on the display screen. Alternatively, the conversion ratio can be changed and set on the basis of the setting of the brightness and color reproducibility on the display screen in accordance with a certain method.

Figure 11:
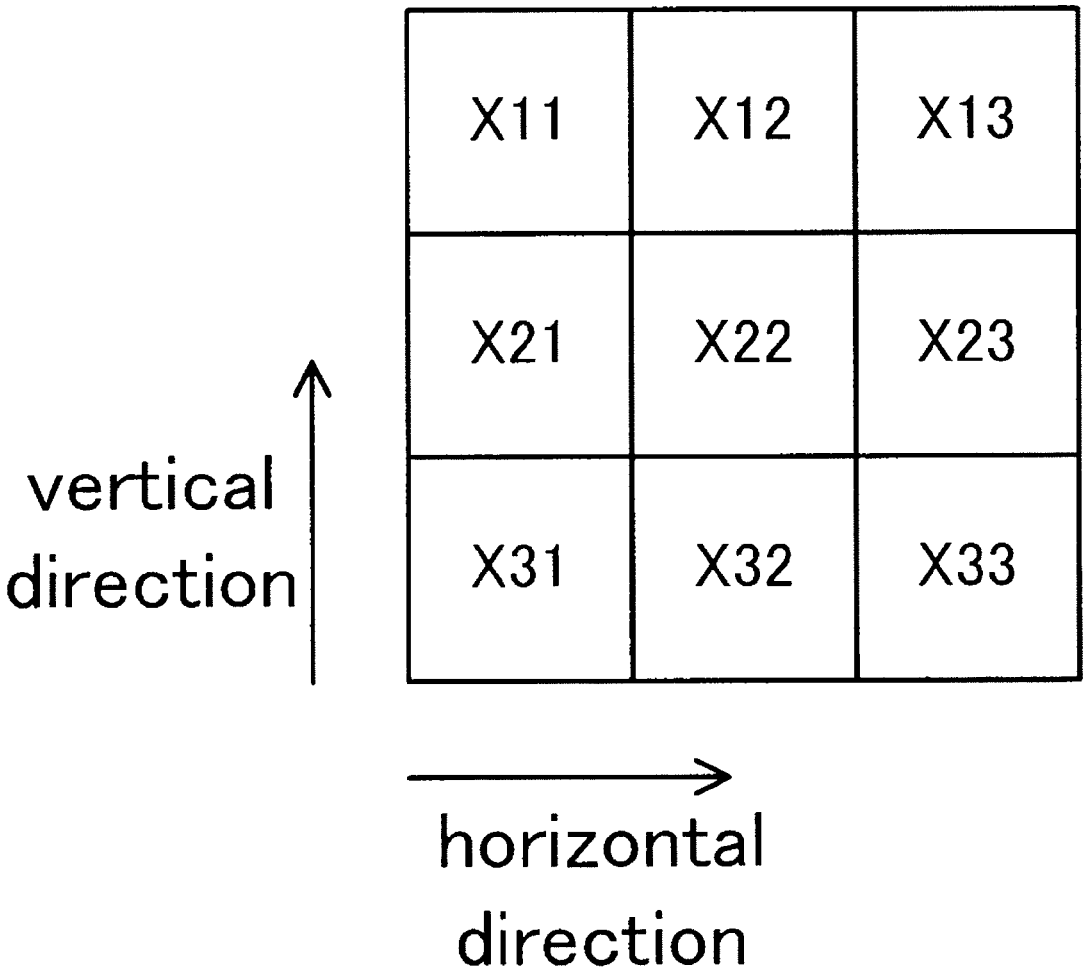
FIG. 11 is a diagram illustrating the gradient of two-dimensional signals according to the present invention.

FIG. 11 shows an example of the two-dimensional alignment of pixels with the reference pixel X22 at the center. According to the present invention, a signal process on the basis of the direction and the gradient in the above described change in the one-dimensional signal can be easily converted to two-dimensional. The above described detection formula for the change in the one-dimensional signal can be used longitudinally and laterally, so that the signal gradient ΔX22 of the reference pixel can be found.

$$\Delta X22V=(X12-X32)$$

$$\Delta X22H=(X21-X23)$$

Here, H indicates the horizontal direction and V indicates the vertical direction.

The distribution coefficient D in the horizontal and vertical direction may be set on the basis of the size. Furthermore, it is easy to add the diagonal direction. In any case, the distribution coefficient is calculated on the basis of the location of pixels which can be displayed.

Change in the signal value for a pixel in the arrangement can be detected using a technique for pattern matching, for example. Several patterns (here, 3×3 pixels) having different directions for the signal gradient are prepared, and the correlation values for the input signal with the signal value for 3×3 pixels is calculated. As a result, the direction of the signal gradient can be found from the type of pattern having high correlation. In addition, the size of the signal gradient can be found from the correlation value. As a result, the coefficient D for distributing the signal value of the reference pixel to surrounding pixels can be calculated. Alternatively, the device configuration may be implemented so that the distribution coefficient D can be directly calculated, without using parameters, such as the direction and gradient of the change in the signals.

Figure 12:
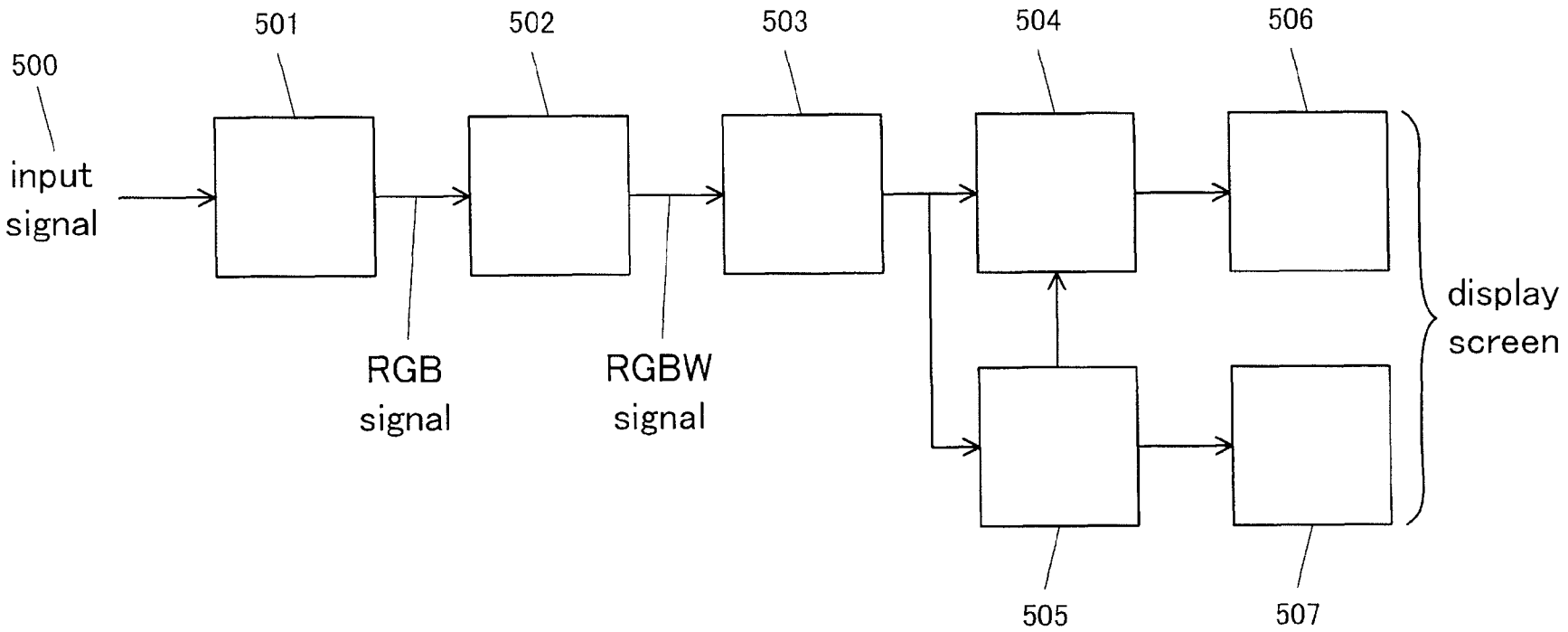
FIG. 12 is a diagram showing an example of the configuration of the display device according to the present invention.

FIG. 12 shows an example of the configuration of a display device using the display signal generating device according to the present invention.

Here an input signal 500 has a pixel configuration of three colors: R, G and B, and the liquid crystal display panel has a pixel configuration of four colors: R, G, B and W. The screen memory 501 stores image data for at least one screen in a data format of three colors: R, G and B, for the purpose of still image holding, timing control, signal processing and the like inside the display device. The W generating means 502 generates color signals for four colors: R, G, B and W, for forming a display panel from the RGB data stored in the screen memory 501. Any method can be used for generating a W signal from the RGB signal, and an example is W=MIN (R, G, B).

The sub-pixel rendering means 503 uses the device configuration in the above described example. The output of this sub-pixel rendering means 503 is used as an RGBW signal for display. This RGBW signal for display is outputted for the display in combination with the liquid crystal panel 506 and the backlight 507.

In order to do so, the maximum value within one screen of the output of the sub-pixel rendering means 503 is detected using the BL (backlight) drive signal calculating means 505, for example, and this is used as a signal for driving the backlight 507. The drive signal for the liquid crystal panel 506 is calculated in order to display the output from the sub-pixel rendering means 503 on the basis of the conditions for turning on the backlight by means of the backlight drive signal set as described above using the panel drive signal calculating means 504. In the above described configuration, there is sometimes a chronological shift with screen units between the screen which is the object for calculating the BL drive signal and the liquid crystal drive signal which is calculated on the basis of the BL drive signal in the case where the display screen changes. However, the updating speed on the display screen (or frame rate) is generally several tens of frames per second, and the above described configuration is provided under the assumption that the above described chronological shift does not affect image quality as can be seen with the eye. In order to eliminate chronological shift, a memory for synchronization with screen units may be prepared.

Though not shown, the sub-pixel rendering means 503 is provided with a means for initially setting the data on the pixel configuration on the liquid crystal panel 506. Assuming that the screen memory 501 can hold data unless a rewriting operation or an erasing operation is carried out, or the power is turned off, only the image region to be updated within the screen may be rewritten through the input of an input signal 500. As a result, the display screen can be formed of RGBW pixels with a small amount of data transfer.

Figure 13:
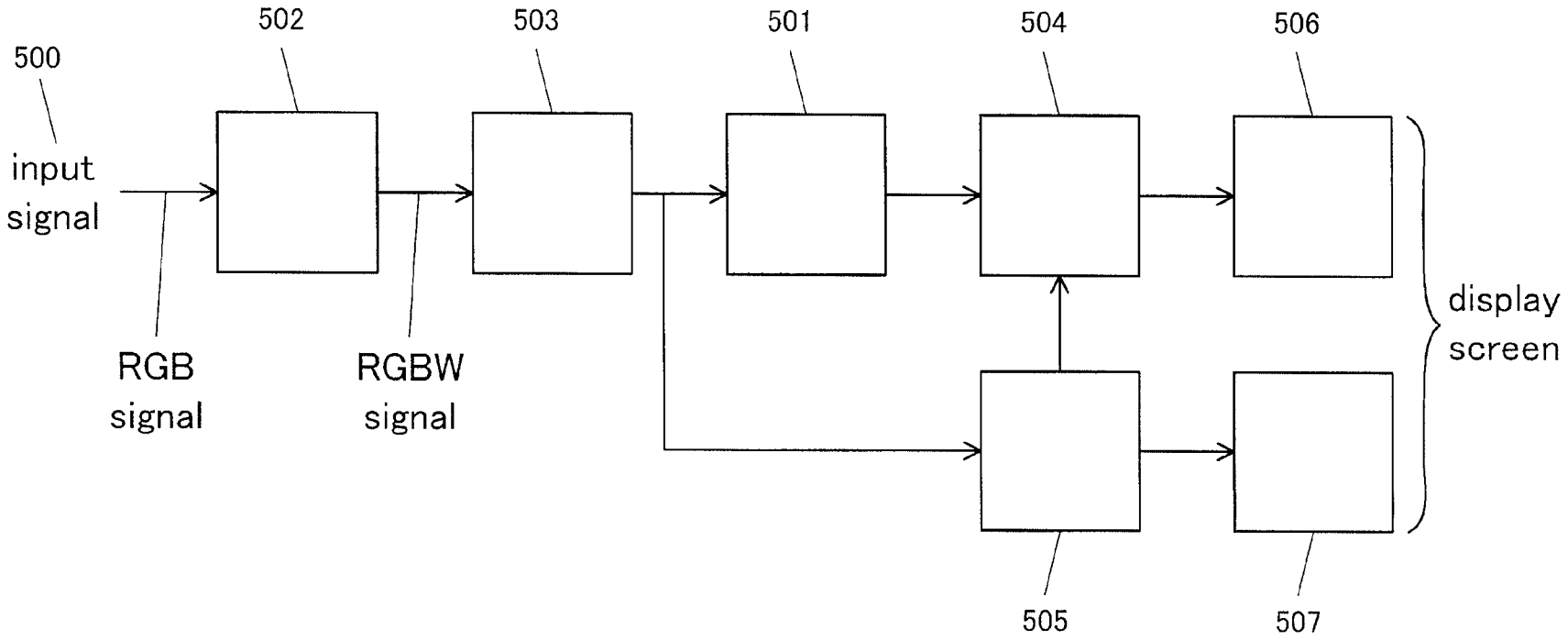
FIG. 13 is a diagram showing another example of the configuration of the display device according to the present invention.

FIG. 13 shows basically the same components as the above, but the configuration is one where the screen memory 501 is provided in a later stage of the sub-pixel rendering means 503. In the case where the pixel configuration on the liquid crystal panel is a subset of RGB or RGBW, the color signal per pixel stored in the screen memory 501 may also be a subset corresponding to the pixel configuration on the liquid crystal panel. In the case where the display panel is formed of two types of pixels: RG and BW, for example, the signals stored in the screen memory 501 may also be formed of two types of color signals per pixel. This provides effects of reducing the data capacity. Here, it is necessary to carry out signal transfer and a signal process, so that the location of pixels on the liquid crystal panel 506 coincides with the location of pixels in the screen memory 501, and this may be achieved using the above described panel pixel configuration storing means 108. In addition, in the case where a screen memory is placed in this location, a BL signal can be calculated with the signal for the display calculated by the sub-pixel rendering means 503 as an object, and the calculation results thereof are used so that the panel drive signal calculating means 504 can calculate a panel drive signal. This allows the screen which is the object of measurement and the screen to be outputted and displayed to be synchronized using the screen memory 501.

The invention claimed is:

1. A color signal generating device for converting signals from a first color signal for forming a number of input pixels representing a combination of colors to be displayed on a position of each pixel of a display device to a second color signal for forming a number of output pixels driving the display device, comprising:

storage for storing information of a combination of colors of sub-pixels included in said each pixel of the display device, a detector circuit for detecting a difference of signal values of colors of the first color signal, displayed on two adjacent pixels which are adjacent across a reference pixel, wherein a first one of the adjacent pixel has a higher signal value and a second one of the adjacent pixel has a lower signal value, and a distributor circuit for distributing a signal value of a color for the reference pixel, wherein the combination of the colors of the sub-pixels of the reference pixel does not have a first color of the first color signal, wherein said first color is in the combination of the colors of the sub-pixels of each of the two adjacent pixels and is displayed on the two adjacent pixels using the second color signal, wherein a value added to said higher signal value of the first one of the adjacent pixels is more than a value added to said lower signal value of the second one of the adjacent pixels; and wherein the value added to the higher signal value of the first one of the adjacent pixels and the value added to said lower signal value of the second one of the adjacent pixels add up to total a signal value of the reference pixel.

2. The color signal generating device according to claim 1, comprising a memory means for storing image data having said number of input pixels the first color signal.

3. The color signal generating device according to claim 1, wherein said combination of colors represented by said first color signal is a color signal having three colors: includes red, green and blue, and said second color signal is a color signal having four colors: said combination of colors of said sub-pixels is one or two colors selected from red, green, and blue and achromatic color.

4. The color signal generating device according to claim 1, further comprising an adding circuit for adding a signal value of a signal value of said color which the combination of the colors of the sub-pixels does not have in the reference pixel in the first color signal to a signal value of a color which is different from said color which the combination of the colors of the sub-pixels does not have, and is displayed on said reference pixel of said second color signal.

5. The color signal generating device according to claim 1, wherein said color which the combination of the colors of the sub-pixels does not have, and is displayed on said reference pixel is an achromatic color.

6. The color signal generating device according to claim 1, wherein said combination of colors represented by said first color signal is a color signal consisting of red, green and blue, and wherein said second color signal is a color signal that has a first color, a second color, a third color and a fourth color, wherein said combination of colors of the sub-pixels comprises one or two colors selected from the group consisting of red, green, blue and an achromatic color.

7. The color signal generating device according to claim 1, wherein the increases signal value for pixels Xi and Xk which are adjacent to reference pixel Xj, is set by the distributor circuit according to the following formula:

$$Xi^*=Xi+Xj\times Di$$

$$Xk^*=Xk+Xj\times Dk$$

wherein color signals Xi and Xk are for pixels Xi and Xk respectively, which are adjacent to reference pixel Xj, and Di and Dk are distribution coefficients, and Xi* and Xk* are the calculated signal value for pixels Xi and Xk.

8. The color signal generating device according to claim 1, wherein a gradient of signal value is calculated for said adjacent pixels.

9. The color signal generating device according to claim 8, wherein according to the gradient of signal value, a distribution ratio is calculated for determining a ratio of signal value to add to each of said adjacent pixels.

10. A display device comprising:

the color signal generating device according to claim 1, a liquid crystal display panel, and a backlight.

11. A color signal generating device comprising:

storage for storing information of a combination of colors of sub-pixels included in each pixel of a display device, a detector circuit for detecting a difference of signal values of colors of a first color signal, displayed on two adjacent pixels, a first pixel and a second pixel, which are adjacent across a reference pixel, wherein the first pixel has a higher signal value and the second pixel has a lower signal value, a distributor circuit for distributing a signal value of a color for the reference pixel to the first and second pixels, wherein the combination of the colors of the sub-pixels of the reference pixel does not have a first color of the first color signal, wherein said first color is in the combination of the colors of the sub-pixels of each of the first and second pixels and is displayed on the first and second pixels using a second color signal, wherein a value added to said first pixels is more than a value added to said second pixel, and wherein the value added to said first pixel and the value added to said second pixel combines to equal a signal value of said reference pixel.

* * * * *